US007690591B2

(12) United States Patent
Baetz et al.

(10) Patent No.: US 7,690,591 B2
(45) Date of Patent: Apr. 6, 2010

(54) ROLLER MILL

(75) Inventors: André Baetz, Juechen (DE); Michael Keyβner, Duesseldorf (DE); Udo Meyer, Krugersdorp (ZA)

(73) Assignee: Loesche, GmbH, Duesseldorf (DE)

( * ) Notice: Subject to any disclaimer, the term of this patent is extended or adjusted under 35 U.S.C. 154(b) by 213 days.

(21) Appl. No.: 11/795,327

(22) PCT Filed: Oct. 19, 2006

(86) PCT No.: PCT/EP2006/010101

§ 371 (c)(1),
(2), (4) Date: Jul. 16, 2007

(87) PCT Pub. No.: WO2007/054191

PCT Pub. Date: May 18, 2007

(65) Prior Publication Data

US 2008/0296422 A1 Dec. 4, 2008

(30) Foreign Application Priority Data

Nov. 14, 2005 (DE) ..... 10 2005 054 209

(51) Int. Cl.
*B02C 23/08* (2006.01)

(52) U.S. Cl. ..... 241/79.1; 241/80; 241/119

(58) Field of Classification Search ..... 241/79.1, 241/79.2, 119, 80
See application file for complete search history.

(56) References Cited

U.S. PATENT DOCUMENTS

| | | | | |
|---|---|---|---|---|
| 1,789,334 | A * | 1/1931 | Englund | 99/286 |
| 2,045,591 | A * | 6/1936 | Falla | 426/482 |
| 2,192,076 | A * | 2/1940 | Grow | 209/315 |
| 3,951,347 | A * | 4/1976 | Tiggesbaumker et al. | 241/52 |
| 4,504,018 | A * | 3/1985 | Diggins | 241/53 |
| 4,597,537 | A * | 7/1986 | Misaka et al. | 241/79.1 |
| 5,180,113 | A * | 1/1993 | Gehrke | 241/79.1 |
| 5,381,968 | A * | 1/1995 | Lohnherr et al. | 241/19 |
| 5,669,559 | A * | 9/1997 | Wagner et al. | 241/23 |
| 5,875,977 | A * | 3/1999 | Kozlak et al. | 241/18 |
| 5,957,300 | A * | 9/1999 | Nardi et al. | 209/143 |
| 6,543,709 | B2 * | 4/2003 | Huang et al. | 241/19 |
| 6,557,790 | B2 | 5/2003 | Splinter | |
| 2004/0084556 | A1 * | 5/2004 | Chen et al. | 241/79.1 |
| 2005/0253002 | A1 | 11/2005 | Viljoen et al. | |
| 2006/0255195 | A1 * | 11/2006 | Chen et al. | 241/79.1 |

FOREIGN PATENT DOCUMENTS

| | | |
|---|---|---|
| DE | 10224009 | 1/2004 |
| EP | 1 247 580 | 10/2002 |
| GB | 428 237 | 5/1935 |
| JP | 05253504 A * | 10/1993 |
| WO | WO 2005/000473 | 1/2005 |

* cited by examiner

*Primary Examiner*—Bena Miller
(74) *Attorney, Agent, or Firm*—Jacobson Holman PLLC

(57) ABSTRACT

The invention relates to a roller mill, particularly intended for dressing ores.

To reduce the energy demand for comminution and classifying a grinding product, a classifying device is positioned below the grinding area and to it is supplied the comminuted ground material under gravity action, as well as classifying air from an annular chamber in the lower region of the grinding bowl and which has at least one fine material outlet and coarse material outlet.

16 Claims, 2 Drawing Sheets

ROLLER MILL

CROSS-REFERENCE TO RELATED APPLICATIONS

This is a nationalization of PCT/EP2006/010101 filed 19 Oct. 2006 and published in German.

BACKGROUND OF THE INVENTION

1. Field of the Invention

The invention relates to a roller mill, particularly for dressing ores, having a rotary grinding bowl surrounded by a grinding area wall and on which roll grinding rollers, an annular area which is bounded by a grinding bowl edge and the grinding area wall, and at least one discharge opening for the comminuted ground material.

2. Related Art

Mills which are used in ore dressing must ensure a careful and gentle comminution. The ground material must only be comminuted to the extent that the following processes for recovering the useful and valuable material of the ore can be performed as efficiently as possible. It is in particular necessary to avoid fines, because they have a negative effect on the following processes.

DE 102 24 009 B4 discloses a shear-free comminution of ores, which uses a LOESCHE-type air-swept rolling mill. The transportation of the ground material within the grinding area and to the classifier, as well as to the downstream dust separator takes place with the aid of an air or gas flow, which flows into the grinding area from an annular duct located below the grinding bowl. As a result of the flow direction from bottom to top and therefore contrary to the force of gravity and the geometrical conditions with respect to the height of the grinding area or the distance from the classifying area, a correspondingly high kinetic energy must be available in order to ensure the pneumatic transport of the ground material particles. The energy costs increase if the size fraction to be transported includes larger ground material particles.

Generally ore dressing requires a coarser size fraction than is required for the cement and power plant industry, where finenesses of e.g. 15% R 0.09 are usual for cement raw material or coal for the downstream burning processes. However, in the case of ores residual values of e.g. 20% R 0.212 are required. This leads to a higher energy demand for the gas flow, so that the known air-swept roller mills can only be used to a limited extent or not at all.

An improved energy balance in the area of particle transport can be obtained if mechanical conveying replaces pneumatic conveying. The ground material fed in the centre of a grinding bowl and which moves outwards as a result of the centrifugal force and is comminuted in the grinding gap between the grinding rollers and grinding surface and then is discharged over the grinding bowl edge, drops into an annular clearance, which is formed by the rotating grinding bowl and a fixed cylindrical housing. Via inclined metal plates in a lower area of the mill the ground material slides to mechanical conveyors, which transport the ground material to separately set up classifying or screening devices, where the fine material is separated from the coarse material. The coarse material is again fed to the mill for further comminution and up to ten cycles are required for obtaining the desired particle size. The fine material is processed in downstream processes.

Such grinding cycles are performed with LOESCHE-type roller mills and are also known in connection with mills of other types, e.g. roller presses (WO 99/54514 A1).

EP 1 247 580 A2 discloses a cyclic grinding device with a high pressure roller mill and a classifier, which are positioned within two fixed side walls and an intermediate, rotary mounted, rotation direction-displaceable material conveying ring for an internal grinding material cycle. In the area below the roller gap of the roller mill is provided a static cascade classifier with V-shaped baffle plates and classifying air is introduced through a feed mechanism housing in one of the side walls into the area below the roller mill. The static cascade classifier acts as a deagglomerator for the roller press scabs or shells. The classifying air containing fines is led out over the side walls, whereas the coarse material particles enter the rotary material conveying ring and are again supplied to the roller mill. A dynamic classifier can also be positioned downstream of the static cascade classifier. This equipment has a relatively significant overall height. Since with both the static and the dynamic classifier the side walls of the operating area form the classifying housing, there are also considerable energy costs.

GB 428 237 discloses a roller mill used for mixing materials and also for comminuting, e.g. ores. The roller mill has, level with the grinding bowl, a discharge opening in the grinding area wall for the comminuted ground material. The horizontal ground material discharge takes place with the aid of fan blades positioned on the underside of the grinding bowl. The grinding process and the degree of comminution are determined by the construction of the housing closely adjacent to the grinding bowl or the grinding area wall, the horizontal discharge opening, the adjustable fan blades and vertical deflectors positioned between the grinding rollers. An alternatively constructed mill has, in addition to the horizontal discharge opening, further openings below the grinding bowl. Into the latter pass the comminuted material which has dropped over the grinding bowl edge and into the annular clearance between the grinding bowl and the lower mill part and it is then mechanically supplied or supplied with the aid of blowers to the further treatment process.

SUMMARY OF THE INVENTION

The object of the invention is to so construct a roller mill that there is no need for a mechanical or pneumatic transport of the comminuted ground material to a classifying or screening system and the desired size fraction can be obtained with relatively limited energy expenditure.

According to the invention the object is achieved by a roller mill having a rotary grinding bowl surrounded by a grinding area wall and on which roll grinding rollers, an annular area which is bounded by a grinding bowl edge and the grinding area wall, and at least one discharge opening for the comminuted ground material, wherein a classifying device is located below the grinding bowl edge and is connected with an annular chamber for the supply of a classifying air flow and that the classifying device which receives the comminuted ground material by gravity, has at least one fine material outlet and a coarse material outlet.

It is a fundamental concept of the invention to provide below the grinding area a classifying device, in which the comminuted ground material comminuted on the grinding bowl and which has dropped downwards over the edge of said bowl as a result of gravity undergoes classification and is separated into a fine and a coarse material fraction.

Classifying takes place with the aid of a gas or air flow, referred to hereinafter as the classifying air flow, which is supplied to the classifying device by means of a lower annular chamber and is discharged containing fines. The coarser ground material particles pass out of the classifying device via a coarse material outlet and said device is integrated into the roller mill for a "down classification".

An energy saving results from this, because there is no need for a conveying of the comminuted ground material to a classifier or to a screening system outside the mill. Additionally no kinetic energy is necessary, because the fall energy of the ground material particles discharged over the grinding bowl edge is utilized.

It is advantageous that the classifying device and the annular chamber are arranged cylindrically around a lower area of the grinding bowl and there are at least one inlet opening for the classifying air flow and at least one fine material outlet and one coarse material outlet in the annular chamber or classifying device wall.

The classifying device below the grinding area can be constructed for static and/or dynamic classification. For example, dynamic classifying rotors can be positioned in the vicinity of the annular area and have a horizontal or vertical rotation axis.

It is advantageous to use a static classifying device constructed as a Venetian blind or jalousie classifier and which is equipped with sloping, overlapping blades. Said jalousie classifiers can be operated with a relatively high dust concentration. In that less gas is required relative to the ground material, a further energy saving is achieved.

Appropriately the blades of the classifying device constructed in jalousie or louver manner are oriented in downwardly sloping and outward manner. The ground material discharged over the grinding bowl edge and which under the influence of the free fall energy drops into the classifying device, strikes the overlapping blades, so that the mass flow is decelerated on impacting on each blade and as a result of the slope is passed over the edge to the next blade. The introduced classifying air flow flows through the jalousie and the ground material curtain. The finer particles are deflected outwards and leave the classifying device with the classifying air flow through the fine material outlet. The coarser particles drop downwards towards the coarse material outlet, which is located in a bottom area of the classifier wall.

It is advantageous that the size of the particles deflected to the fine material outlet can be influenced by the gas quantity and the resulting speeds between the blades. If the fine material-gas flow is subject to a deflection of e.g. approximately 90° following the blades, an additional separation effect is achieved.

In order to ensure that classifying air or gas cannot enter the annular and grinding area in opposition to the downwardly falling, comminuted ground material, cover elements are provided and are able to bound and limit the annular area opening axially and/or in ring segment-like manner and fulfill a sealing function. Appropriately the cover elements are constructed as flaps or ring segments and bound the annular area opening in such a way that it is completely filled by the ground material flow discharged over the grinding bowl edge. The cover elements are appropriately adjustable and in particular pivotable about a horizontal axis and fixed to the grinding area wall.

LOESCHE-type, modular roller mills which have grinding rollers separately supported and pivotably mounted on mill standards are equipped with a classifying device, which in each case has classifying areas between the standards. In each classifying area is coaxially and externally provided a fine material outlet, e.g. a connecting piece, and at the bottom a coarse material outlet and the bringing together thereof takes place outside the mill.

The annular chamber in the lower area of the grinding bowl completely surrounds the latter, the seal with respect to the rotary grinding bowl being provided by a gland or labyrinth packing or gap sealing.

In the areas of the mill standards, between the individual classifying areas, which can advantageously be constructed as louvers or jalousies, is provided a cylindrical part or a part cylindrical connecting wall, which extends into the upper area of the grinding bowl and is e.g. here sealed by a gland or gap sealing.

To deflect the comminuted ground material discharged by the grinding bowl into the classifying areas between the mill standards there are baffle plates below the grinding rollers in the annular area between the grinding bowl and the grinding area wall. In the upper area said baffle plates have a roof-shaped construction and are supported on vertical baffle plates. Fixing can occur on the vertical connecting wall.

BRIEF DESCRIPTION OF THE DRAWINGS

The invention is described in greater detail hereinafter relative to the attached diagrammatic drawings, wherein show.

DETAILED DESCRIPTION OF THE PREFERRED EMBODIMENTS

Figure 1:
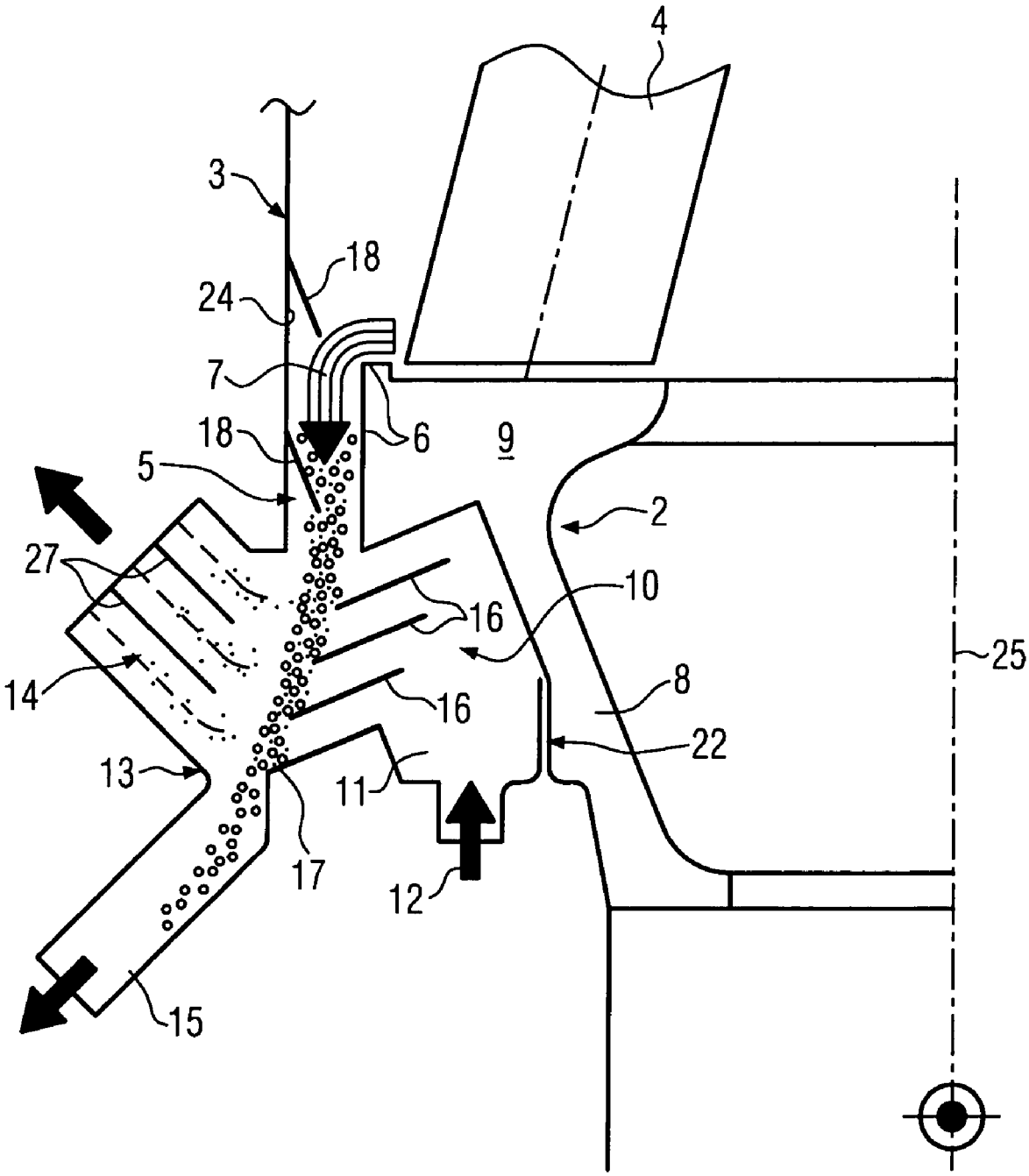
FIG. 1 is a detail longitudinal section through an inventive roller mill with integrated classifying device below the grinding area.

FIG. 1 is a longitudinal section through the left-hand side of a roller mill in the vicinity of a grinding roller 4, which rolls on a grinding bowl 2. Grinding bowl 2 rotates about a rotation axis 25 and the ground material 7 comminuted in a grinding gap between the grinding roller 4 and the grinding bowl 2 passes over the grinding bowl edge 6 into an annular area 5. The annular area 5 is bounded by the grinding bowl edge 6 and a grinding area wall 3, which is substantially vertically oriented. In the upwards direction the grinding area can have a not shown cover and a dust removal device can also be provided. However, the mill can also be operated in an open air process.

A classifying device 10 to which classifying air flow 12 is supplied via an annular chamber 11 is positioned below the grinding bowl edge 6 and annular area 5.

In the present embodiment the classifying device 10 is a static louver-type classifier or jalousie classifier, which has sloping, overlapping blades 16.

The classifying device 10 with the blades 16 is positioned in such a way that the comminuted ground material 7, which drops downwards solely as a result of fall energy over the grinding bowl edge 6 and annular area 5, strikes the individual blades 16, is decelerated and classified with the aid of the classifying air flow 12 passing through the blades 16. The fine material separated from the coarse material passes with the classifying air outwards through a fine material outlet 14, which extends over virtually the entire height of the classifying device 10 and coaxially thereto in an outer wall 13, whereas the coarse material is discharged via a coarse material outlet 5 in a bottom wall 17 of the classifying device 10.

FIG. 1 makes it clear that the fine material outlet is so positioned in the outer wall 13 that the fine material-containing classifying air undergoes a deflection, which leads to an additional separation effect. A removal of any still entrained coarse particles can also be brought about by guide plates 27, which are located in the fine material outlet 14. FIG. 1 also shows that the bottom wall 17, which is bounded on the inside by the annular chamber 11 and on the outside by the coarse material outlet 15, has the same inclination as the blades 16 of the classifying device 10.

In the annular area 5 cover elements 18 are pivotably fixed to the grinding area wall 3, which prevent classifying air 12 from passing via the annular area 5 into the grinding area and acting against the downwardly falling, comminuted ground material 7. The two positions of the cover elements 18 shown in FIG. 1 are of an exemplified nature and can also be provided in alternative form. The cover element 17 can be pivoted in such a way that the annular area 5 has an opening completely filled by the comminuted ground material flow.

The annular chamber 11 which extends in a lower area 8 of the grinding bowl 2 around the latter, has a gland/labyrinth packing or gap sealing 22 with respect to the grinding bowl 2. The grinding area wall 3 can in the vicinity of the grinding bowl edge 6 be constructed as a baffle 24 and can be provided with a not shown, wear-resistant lining.

Figure 2:
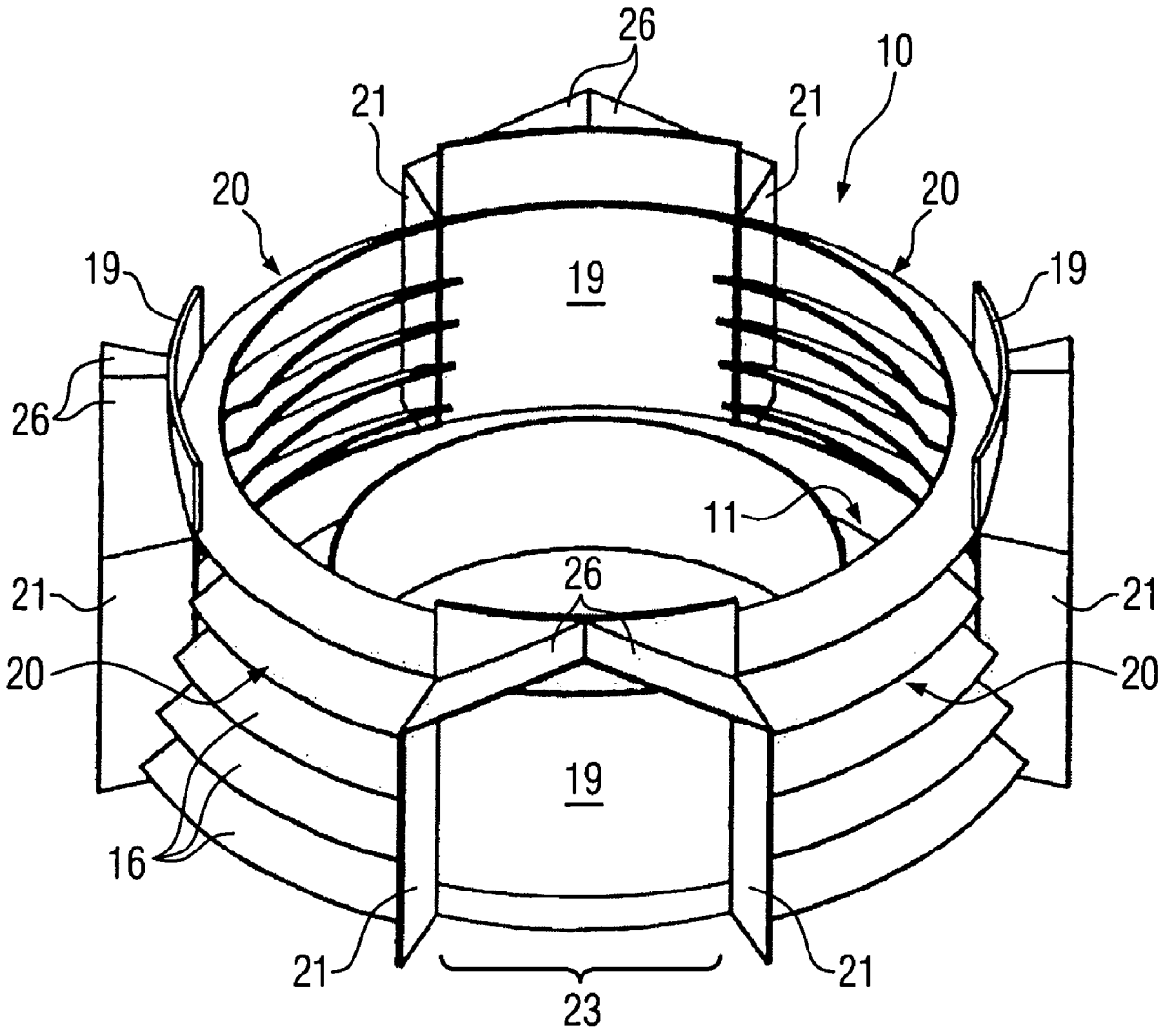
FIG. 2 is a perspective view of the classifying device for a modular roller mill with four grinding rollers/mill standards.

FIG. 2 perspectively shows a classifying device 10, which is constructed for installation below the grinding bowl of a LOESCHE-type, modular, roller mill. The classifying device 10 is provided with classifying areas 20, which are located between the not shown mill standards. The annular chamber 11, into which the classifying air or gas 12 is introduced, surrounds the grinding bowl 2 (cf. FIG. 1) in a lower area in a complete manner. In FIG. 2 the classifying areas 20 are once again blades with outwardly and downwardly inclined blades 16, in the vicinity of which are externally provided connecting pieces as the fine material outlet 14 in outer housing 13 (cf. FIG. 1).

In the areas 23 of the not shown mill standards, i.e. below the grinding rollers 4 (cf. FIG. 1), are provided between the classifying areas 20 in the form of an outer boundary part cylindrical connecting walls 19 which are positioned vertically, extend up to the grinding bowl 2 and are here sealed with respect to the rotary bowl by means of a not shown gland. To ensure that the comminuted ground material 7 discharged from the grinding bowl enters the classifying areas 20, baffle plates 21 are vertically oriented and arranged in the form of a roof slope 26 are fixed to the associated connecting wall 19. The blades 16 of the classifying areas 20 in each case extend up to the vertically positioned baffle plates 21.

The invention claimed is:

1. A roller mill comprising:

a rotary grinding bowl (2) having a grinding bowl edge (6), a grinding area wall (3) surrounding the rotary grinding bowl, grinding rollers (4) rolling on the rotary grinding bowl, an annular area (5) which is bounded by the grinding bowl edge (6) and the grinding area wall (3), at least one discharge opening in the annular area (5) for discharge of comminuted ground material (7) comminuted between the grinding rollers (4) and the grinding bowl (2), an annular chamber (11) for the supply of a classifying air flow (12), and an integrated classifying device (10) located below the grinding bowl edge (6), wherein the classifying device (1) receives the comminuted ground material (7) by gravity from the at least one discharge opening, is connected with the annular chamber (11), and has at least one fine material outlet (14) and a coarse material outlet (15).

2. The roller mill according to claim 1, wherein the classifying device (10) and the annular chamber (11) are arranged cylindrically around a lower area (8) of the grinding bowl (2).

3. The roller mill according to claim 1, wherein the classifying device (10) is constructed for at least one of static classifying and dynamic classifying.

4. The roller mill according to claim 1, wherein the classifying device (10) is constructed as a jalousie with sloping, overlapping blades (16).

5. The roller mill according to claim 4, wherein the blades (16) of the classifying device (10) are directed in a downwardly sloping, outward manner and classifying air flow (12) is passed out of the annular area (11) upwards through the blades (16).

6. The roller mill according to claim 1, wherein the fine material outlet (14) is located in an outer wall (13) of the classifying device (10) and substantially coaxial to the classifying device (10).

7. The roller mill according to claim 1, wherein the coarse material outlet (15) is located in a bottom wall (17) of the classifying device (10).

8. The roller mill according to claim 1, further comprising cover elements (18) in or above the annular area (5) for limiting the discharge opening in the annular area for sealing against classifying air (12) from the classifying device (10).

9. The roller mill according to claim 8, wherein the cover elements (18) are constructed as flaps or ring segments and fixed adjustably to the grinding area wall (3).

10. The roller mill according to claim 1, wherein the grinding rollers (4) are pivotably mounted and separately supported on mill standards, and wherein the classifying device (10) has in each case classifying areas (20) which are positioned between said standards.

11. The roller mill according to claim 10, further comprising a part cylindrical connecting wall (19) in an area (23) of the mill standards, which connects the classifying areas (20) and extends into an upper area (9) of the grinding bowl (2).

12. The roller mill according to claim 10, further comprising baffle plates (21) provided below the grinding rollers (4) in the annular area (5) between the grinding bowl (2) and grinding area wall (3), for supplying comminuted ground material (7) to the classifying areas (20).

13. The roller mill according to claim 12, wherein the baffle plates (21) are positioned vertically in the form of a roof slope (26) and are fixed to the part cylindrical connecting walls (19).

14. The roller mill according to claim 1, further comprising gland/labyrinth packings (22) for sealing purposes in an area of the annular chamber (11) and a lower area (8) of the grinding bowl (2) and in an area of the part cylindrical connecting walls (19) and the upper area (9) of the grinding bowl (2).

15. The roller mill according to claim 1, wherein a size fraction of the fine and coarse material from the classifying device (10) is adjustable with the aid of the quantity and the resulting speed of a classifying air flow (12).

16. The roller mill according to claim 1, further comprising guide plates (27) provided in the fine material outlet (14) in a flow direction, and wherein a fine material-classifying air flow is deflected to the fine material outlet (14).

* * * * *